US005913274A

United States Patent [19]

Künzli et al.

[11] Patent Number: 5,913,274

[45] Date of Patent: Jun. 22, 1999

[54] INCINERATION GRATE WITH INTERNAL COOLING

[75] Inventors: Max Künzli, Boswil; John Millard, Stäfa; Peter Serck-Hanssen, Zürich, all of Switzerland

[73] Assignee: Asea Brown Boveri AG, Baden, Switzerland

[21] Appl. No.: 08/921,243

[22] Filed: Aug. 29, 1997

[30] Foreign Application Priority Data

Nov. 21, 1996 [DE] Germany ..... 196 48 128

[51] Int. Cl.[6] ..... F23H 17/00; F23H 13/00; F23H 17/12; F23K 3/12

[52] U.S. Cl. ..... 110/328; 110/268; 110/281; 110/291; 110/327; 126/152 R; 126/152 B; 126/167; 126/174; 126/175

[58] Field of Search ..... 110/267, 268, 110/281, 286, 291, 298, 327, 328; 126/152 R, 163 R, 174, 175, 167, 152 B

[56] References Cited

U.S. PATENT DOCUMENTS

| | | | |
|---|---|---|---|
| 4,314,541 | 2/1982 | Martin et al. | 126/163 R |
| 5,174,747 | 12/1992 | Massaro, Jr. et al. | 432/78 |
| 5,680,824 | 10/1997 | Kemter et al. | 110/348 |
| 5,724,898 | 3/1998 | Von Bockh et al. | 110/291 |

FOREIGN PATENT DOCUMENTS

| | | |
|---|---|---|
| 0663565A2 | 7/1995 | European Pat. Off. . |
| 0713056A1 | 5/1996 | European Pat. Off. . |
| 0757206A2 | 2/1997 | European Pat. Off. . |
| 498538 | 5/1930 | Germany . |
| 974490 | 1/1961 | Germany . |
| 9416320 | 2/1995 | Germany . |
| 84417 | 3/1920 | Switzerland . |
| 684118A5 | 7/1994 | Switzerland . |
| 116932 | 7/1918 | United Kingdom . |

*Primary Examiner*—Ira S. Lazarus
*Assistant Examiner*—Ljiljana V. Ciric
*Attorney, Agent, or Firm*—Burns, Doane, Swecker & Mathis, L.L.P.

[57] ABSTRACT

A grate for a firing plant, having at least one grate track with a plurality of fixed and moving rows of grate-lining units, which rows alternate in the longitudinal direction, are bounded on both sides by side walls and are provided with cooling passages as well as with feed and discharge lines. The grate-lining units are connected at their rear end to a fixed or movable grate-lining bearer and rest with their front end on the following grate-lining unit, and the cooling passages being arranged essentially transversely to the longitudinal direction of the grate. The cooling passages are tubes arranged in a meander shape and integrally cast in the grate-lining units and whose spacing is adapted to the thermal loading on the grate-lining units. The tube spacing preferably decreases from the rear end to the front end of the grate-lining unit.

11 Claims, 5 Drawing Sheets

INCINERATION GRATE WITH INTERNAL COOLING

BACKGROUND OF THE INVENTION

1. Field of the Invention

The invention relates to the field of combustion technology. It relates to a grate for a firing plant, having at least one grate track with a plurality of fixed and moving rows of grate-lining units, which rows alternate in the longitudinal direction, are bounded on both sides by side walls and in each case comprise at least one grate-lining unit provided with feed and discharge lines and with cooling passages, the grate-lining units being pivotably connected in each case in the region of their rear end to a fixed or movable grate-lining bearer and being movably arranged with their front end on or above the following grate-lining unit, and the grate-lining units of a row of grate-lining units in each case being connected by connecting means, arranged below the same, in such a way that adjacent grate-lining units are pivotable to a limited extent relative to the grate-lining bearer allocated to them.

In this case, the invention makes reference to a prior art as disclosed, for example, by Swiss Patent 684 118.

2. Discussion of Background

Grates of the generic type mentioned at the beginning serve to burn and at the same time convey combustion material further and are used in particular in refuse incineration plants.

In addition to air-cooled grate-lining units, also called grate bars or grate plates, water-cooled grate-lining units have been used for years. This is because changes in the composition of waste have led to considerable increases in the calorific value and thus to higher grate wear and higher operating costs. The use of primary air as cooling medium is therefore no longer adequate for these purposes.

German Patent Application St 942 V/24f discloses a stoking grate which consists of alternately fixed and movable rows of grate bars, the fixed rows of grate bars consisting of cooling tubes which lie transversely to the grate direction and are connected in the boiler cooling-water circuit and to which grate bars partly enclosing the tubes are fastened in a close-fitting manner, the cooling tubes being arranged at a constant distance from one another.

Only a very modest cooling effect can be achieved with this solution. On the one hand, only the fixed rows of grate bars can be cooled, since the cooling tubes span the entire grate widthwise. On the other hand, the cooling effect decreases in the transverse direction of the row of grate bars, so that the side of the row of grate bars at which the cooling water is discharged is subjected to greater thermal loading than the side at which the cooling water is fed.

Furthermore, German Patent 498 538 discloses a water-cooled stepped grate having movable grate members. Grate steps are described which are downwardly staggered like stairs and in which cooling water flows transversely to the longitudinal direction of the grate, i.e. transversely to the transport direction of the combustion material, in water troughs which are arranged transversely to the individual steps, are closed by a loosely mounted lid and directly cool only the center region of the grate step. The feed and discharge tubes for the cooling liquid are located in each case at the opposite ends of the trough. A disadvantage with this prior art is that the cast-on comb-like grate bars, which are especially subjected to thermal loading, are not directly cooled in this technical solution.

The thrust combustion grate disclosed by Swiss Patent 684 118 has a grate plate which consists of an essentially rectangular sheet-metal hollow body which has a connecting piece on one side of its underside and a discharge piece on the other side of its underside for the feed and discharge of a cooling fluid flowing through the hollow body. The feeding of primary air is effected via a multiplicity of tubular elements running through the hollow space, the primary-air feed being individually metered for each tubular element.

A disadvantage with this prior art is that, apart from the expensive manufacture of the grate plate, no differentiation of the cooling of the cooling element is possible, although it is known that the thermal loading on the grate lining changes to a great extent in the longitudinal direction of the grate. The undifferentiated cooling has the disadvantage that different temperatures are produced in the element, which contribute to internal stresses and possible corrosion. Furthermore, the cooling space in this solution is substantially larger than the feed and discharge lines. Where there are changes in cross section, however, there is the risk of particles being deposited, e.g. corrosion products and dirt, and thus of the flow pattern and the heat transfer changing in the course of time. In addition, an abrupt change in cross section promotes the formation of vortices, so that air bubbles can be left in the cooling passage, a factor which influences the heat transfer and may also lead to erosion.

Furthermore, EP 0 663 565 A2 discloses a grate bar having a cooling arrangement and a feed and discharge opening arranged in the grate bar, in which at least one passage for directing cooling water runs essentially in the longitudinal direction of the grate bar. The passage arranged in the grate bar preferably has two essentially parallel sections with a direction of flow opposed to one another, these sections being connected to a return point arranged in the head region of the grate bar. A disadvantage with this prior art is that, here, too, no differentiation of the cooling in the longitudinal direction and thus no adaptation to the progression of the thermal loading can be effected.

As a rule, funnel-shaped underblast zones are nowadays made underneath the grate rows. This funnel shape often limits the accessibility to the marginal zones of the grate, in particular for the feed and discharge hoses, which require a movement in one plane so as not to be exposed to any torsional stress.

SUMMARY OF THE INVENTION

Accordingly, one object of the invention, in attempting to avoid all these disadvantages, is to provide a novel grate lining for a firing plant, which grate lining is provided with cooling passages for water or another cooling medium, can be manufactured in a favorable manner and permits differentiated cooling in the longitudinal direction of the grate. In addition, the feed and discharge hoses for the cooling medium are to be readily accessible and there is to be a uniform cross section of flow for the cooling medium.

According to the invention, this is achieved in that, in a grate according to the preamble of claim 1, the cooling passages running essentially transversely to the longitudinal direction of the grate are tubes which are arranged in a meander shape and are integrally cast in the grate-lining units and whose spacing is adapted to the thermal loading on the grate-lining units which is to be expected in each case. The spacing of the tubes preferably decreases from the rear end to the front end of the grate-lining unit.

The advantages of the invention consist, inter alia, in the fact that this grate can be manufactured in a relatively favorable manner. The cooling tubes are prefabricated as semifinished products and are then integrally cast in the grate-lining unit. The cooling-tube cast part forms a perfect construction in which the known problems of a cast-steel weld cannot occur. In addition, due to the varying tube spacing, the cooling capacity is adapted to the thermal stress, which is especially efficient.

It is especially expedient if, in a grate track which comprises two lateral grate-lining units according to the invention and at least one center grate-lining unit according to the invention arranged in between, the lateral grate-lining units are designed to be a mirror image of one another with regard to the path of the cooling passage, and the connection points for the feed and discharge lines are in each case arranged in the lateral grate-lining units on one and the same side of the grate-lining unit. Consequently, feed and discharge lines for the cooling medium no longer have to be arranged in the marginal zones of the grate track, which are not very accessible, but can be arranged outside the marginal zones of the funnel-shaped underblast box.

Furthermore, it is advantageous if the cooling tubes of adjacent grate-lining units of a row of grate-lining units are connected to one another via a coupling, preferably a tube or a hose connection, which has a U-shape or an S-shape, and the feed and discharge lines, the couplings and the integrally cast tube have the same inside diameter. A uniform cross section of flow for the cooling medium is thereby obtained. No abrupt changes in cross section occur, so that the formation of vortices and the deposition of foreign particles are prevented or made more difficult.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
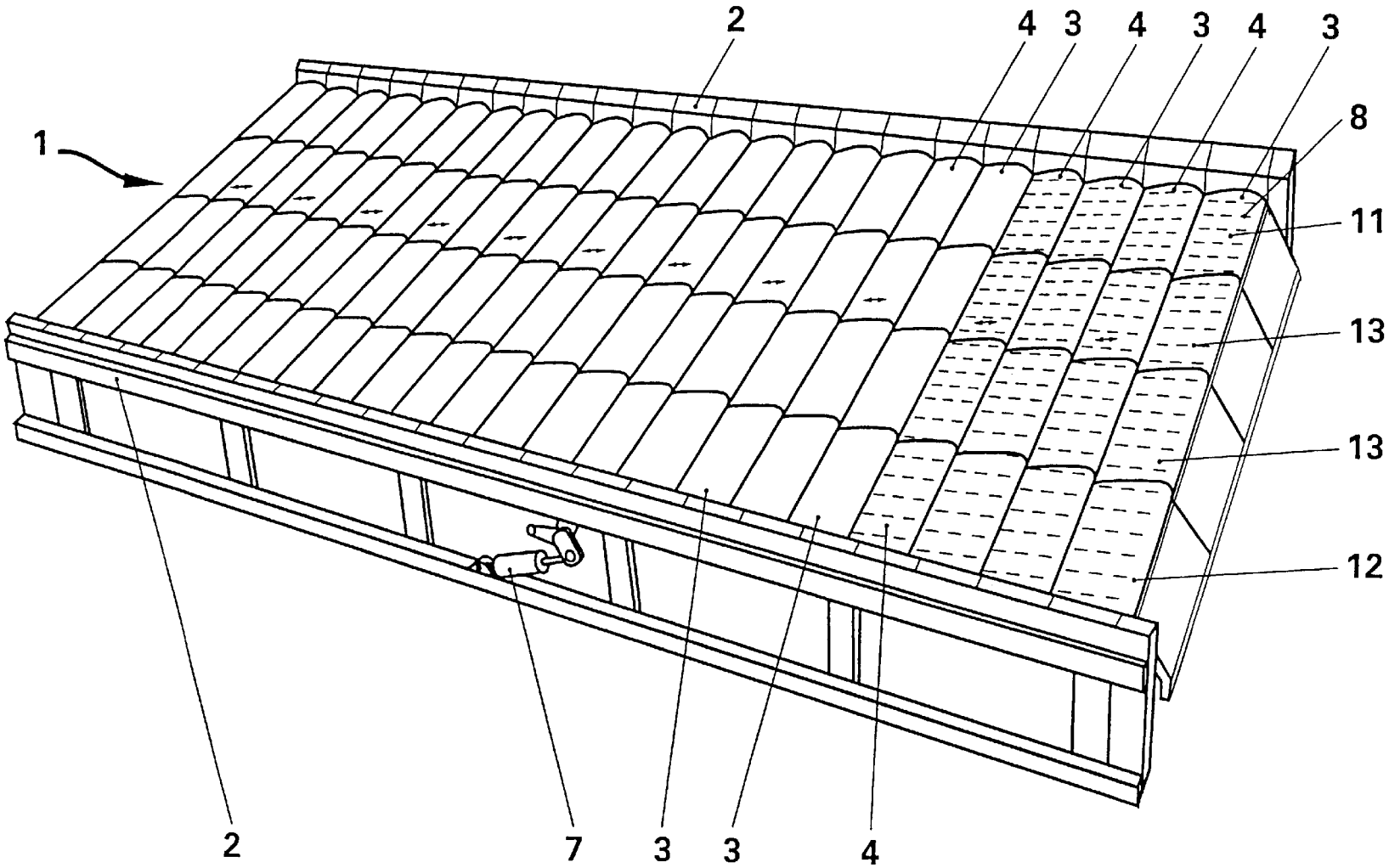
FIG. 1 shows a perspective representation of a feed grate consisting of moving and fixed rows of grate-lining units.

Referring now to the drawings, wherein like reference numerals designate identical or corresponding parts throughout the several views and only the elements essential for understanding the invention are shown, FIG. 1 shows a combustion grate for a firing plant, for example a refuse incineration plant, having a grate track 1 which is bounded on both sides by side walls 2. The grate may also have two or more grate tracks 1 arranged next to one another and separated by center beams.

The grate track 1 is constructed from a grate lining which is composed of grate-lining units 11, 12, 13, so-called grate bars or grate plates. In this case, fixed rows 3 of grate-lining units and moving rows 4 of grate-lining units are arranged alternately in the longitudinal direction of the grate. At the rear end, each grate-lining unit 11, 12, 13 is designed as a half-open tube 5 with which the grate-lining unit 11, 12, 13 rests on a grate-lining-unit bearer 6, which is designed here as a rod of circular cross section (cf. FIG. 2). The grate-lining-unit bearers 6 allocated to the fixed rows 3 of grate-lining units are firmly connected to the side walls 2, whereas the grate-lining-unit bearers 6 allocated to the moving rows 4 of grate-lining units are connected to one another and are arranged so as to be displaceable in the longitudinal direction of the grate. The moving rows 4 of grate-lining units can be moved in a reciprocating manner relative to the fixed rows 3 of grate-lining units by double-acting hydraulic or pneumatic cylinders (not shown here) arranged on both sides.

The grate-lining units 11, 12, 13 themselves mostly comprise a flat plate which is bent downward at its front end and ends there in a sliding piece 7 running approximately parallel to the plate. There, the grate-lining unit 11, 12, 13 rests on the next grate-lining unit 11, 12, 13 in the direction of movement of the combustion material. In the example, three rows of narrow openings 8 (slots) are provided which widen toward the bottom in both the longitudinal and transverse direction and run parallel to the longitudinal direction of the grate. Primary air is fed through these openings 8 from the underside of the grate.

According to the example shown in FIG. 1, each row 3, 4 of grate-lining units consists of two lateral 11, 12 and two center grate-lining units 13, which are connected to the adjacent grate-lining units via screws arranged in openings made at the side. The number of center grate-lining units 13 in a row 3, 4 may of course also differ from two. In another exemplary embodiment, it is also possible for only one grate-lining unit, designed according to the invention and extending from one side wall 2 to the other side wall 2 of the grate track 1, to be arranged for each row 3, 4 of grate-lining units.

As already explained at the beginning, the grate lining is subjected to considerable thermal stresses during operation of the firing plant. Since the cooling with the primary air flowing from below through the grate is not sufficient on its own in order to obtain a grate lining having a long service life, provision is made according to the invention for tubes 9 arranged in a meander shape and integrally cast in the grate-lining units 11, 12 to be arranged essentially transversely to the longitudinal direction of the grate, the longitudinal direction of the grate corresponding to the direction of movement of the combustion material, the spacing of which tubes 9 is not constant but is adapted to the respective thermal loading on the grate-lining unit 11, 12, 13. Thus, for example, a tube spacing decreasing from the rear end to the front end of the grate-lining unit is provided. A cooling medium, preferably water, is directed through these tubes 9 during operation of the combustion grate.

Figure 2:
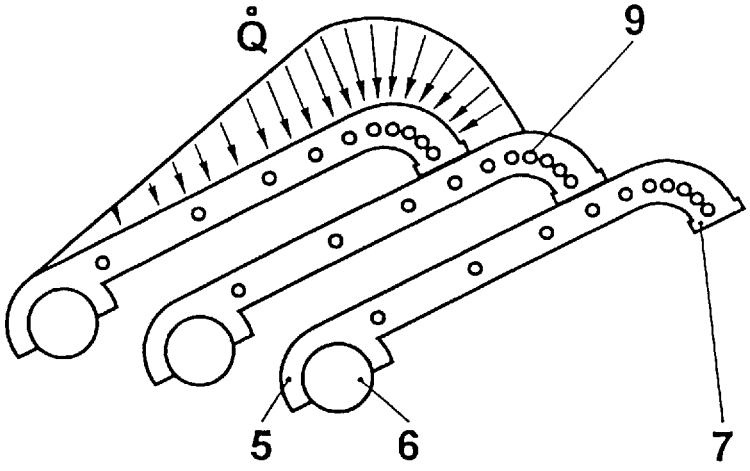
FIG. 2 shows a diagrammatic longitudinal section through three adjacent grate-lining units according to the invention.

FIG. 2 shows, as an example, a simplified longitudinal section through three grate-lining units according to the invention, which are arranged one behind the other in the longitudinal direction of the grate, the respective thermal loading Q of the grate-lining unit being plotted schematically over the part shown on the left. It will be seen that, in this example, the thermal loading increases from the rear end to the front end of the grate-lining unit and is greatest in the head region. The spacing of the cooling tubes 9 is therefore selected in such a way that the smallest spacing is in the head region, i.e. the distance between the parallel tube sections 9 arranged transversely to the longitudinal direction of the grate is smallest in the head region, hence at the front end of the grate-lining unit. It is generally true of the present solution according to the invention that the tube spacing is adapted to the thermal loading to be expected in each case, i.e. that the smallest tube spacing in another exemplary embodiment may also be provided at a point other than in the head region.

Figure 3:
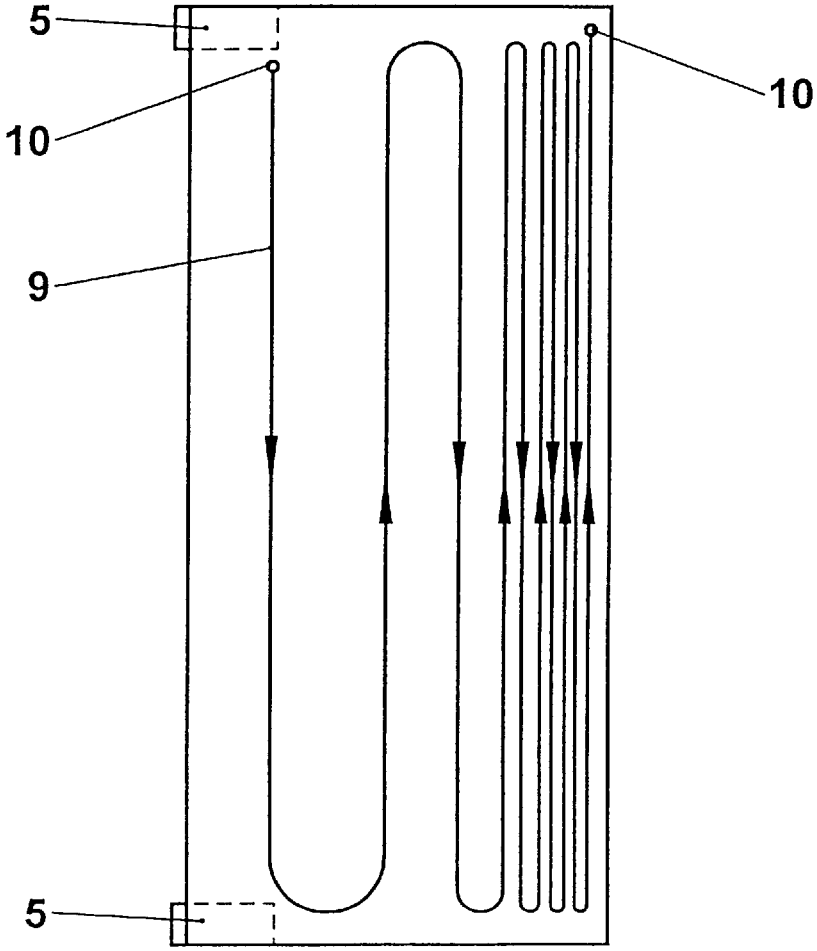
FIG. 3 shows a schematic plan view of a grate-lining unit according to FIG. 2.

FIG. 3 schematically shows a plan view of a grate-lining unit according to the invention. In this example, cooling liquid is introduced into the tube 9 via a connection 10 near the rear end, designed as a half-open tube piece 5, of the grate-lining unit. This cooling liquid flows through the tube 9, which is arranged essentially transversely (in a meander shape) and whose spacing decreases toward the front end of the grate-lining unit in the longitudinal direction of the grate, up to the second connection 10 located at the front end of the grate-lining unit and from there into a drain line (not shown here). Of course, the cooling medium may also be fed at the front end of the grate-lining unit and discharged at the rear end of the grate-lining unit. The direction of flow of the cooling liquid, which is illustrated by arrows in FIG. 3, is of secondary importance, since the temperature difference of the cooling liquid between the inlet and the outlet into and respectively from the grate-lining unit is relatively small.

The solution according to the invention ensures that the cooling effect is greatest in the region subjected to the highest thermal stress, so that the temperature- and stress-induced wear of the grate lining is reduced as a result of the differentiation of the cooling in the longitudinal direction of the grate.

The manufacture of the grate-lining units according to the invention is comparatively simple and economical. The cooling tubes 9 are prefabricated as semifinished products, then a tube 9 ready for a mold is put into the casting mold for the grate-lining unit and the grate lining is cast.

Figure 4:
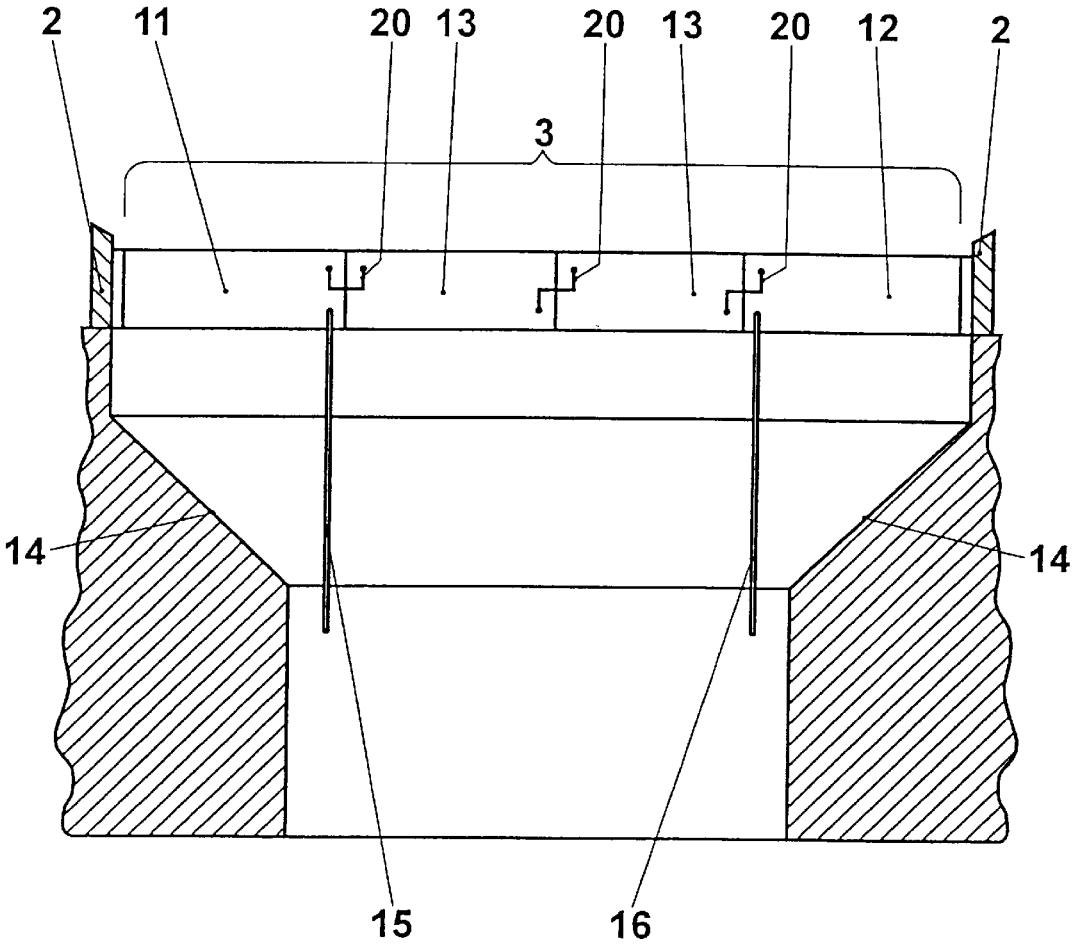
FIG. 4 shows a grate cross section as viewed in the conveying direction.

FIG. 4 shows a grate cross section (viewed in the conveying direction). In this example, the row 3 of grate-lining units consists of four grate-lining units arranged next to one another, specifically a left-hand lateral grate-lining unit 11 and a right-hand lateral grate-lining unit 12 and two center grate-lining units 13. The grate is not very accessible in the marginal zones, i.e. in the funnel-shaped underblast zones 14, which are shown as a hatched region in FIG. 4. With the solution according to the invention, it is possible for the feed and discharge lines 15, 16, which are preferably hoses, for the cooling medium to be arranged in such a way that they lie outside this region.

The tubes 9 of the two center grate-lining units 13 are connected to one another as well as in each case to the tubes 9 of the adjoining lateral grate-lining unit 11, 12 via couplings 20. The coupling 20 is preferably a tube or a hose connection which has a U-shape or an S-shape. FIG. 4 shows how two center grate-lining units 13 can be inserted between the marginal units in principle with two S-shaped couplings and one U-shaped coupling 20.

Figure 5:
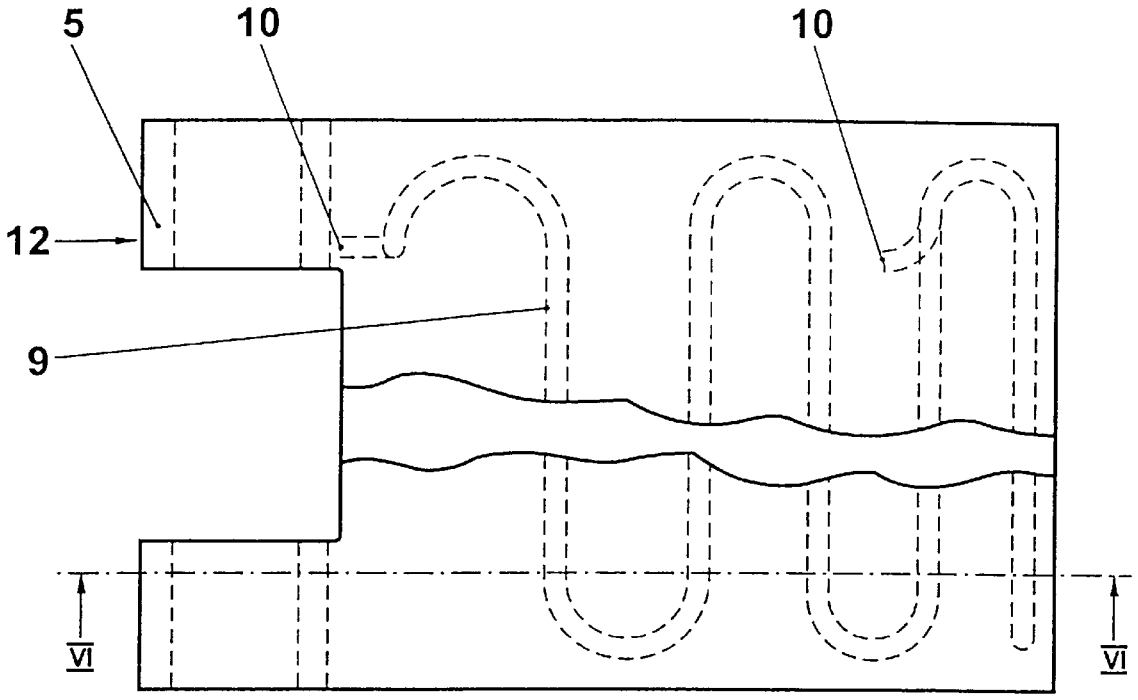
FIG. 5 shows a plan view of a lateral grate-lining unit.
Figure 6:
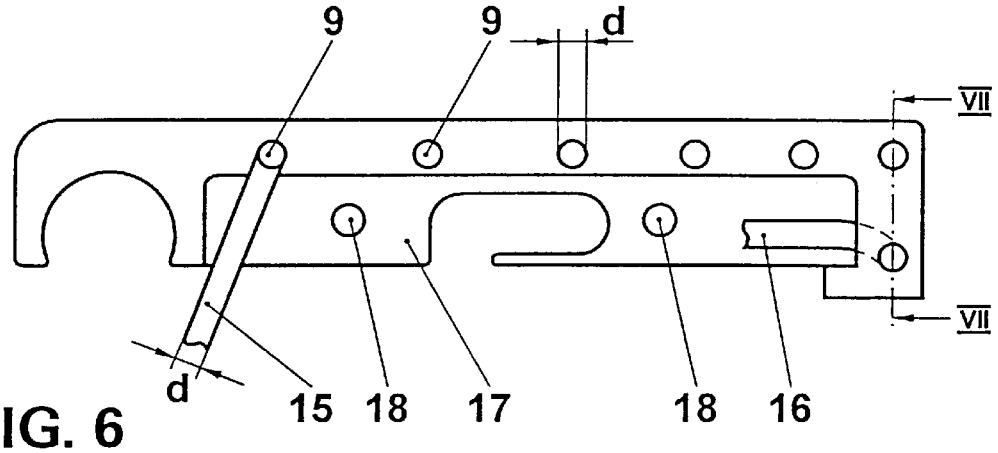
FIG. 6 shows a section along line VI—VI according to FIG. 5.
Figure 7:
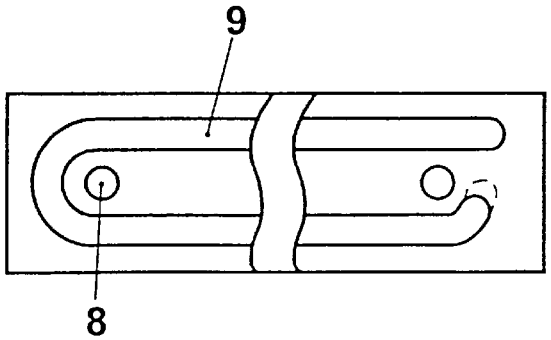
FIG. 7 shows a section along line VII—VII according to FIG. 6.

A lateral (the right-hand) grate-lining unit 12 of a row of grate-lining units is shown in detail in FIGS. 5 to 7. FIG. 5 shows a plan view, from which it is clearly apparent that the connection points 10 of the feed and discharge lines 15, 16 are arranged in this lateral grate-lining unit 12 in such a way that in each case there is one at the rear end and one at the front end of the grate-lining unit 12 and both, for reasons of accessibility, are arranged at one and the same narrow side (in FIG. 5 at the top) of the grate-lining unit 12. The differentiation of the tube spacing in the longitudinal direction can likewise easily be seen.

FIG. 6 shows a section along line VI—VI in FIG. 5, once again, that is, a lateral representation of the grate-lining unit 12, in which the feed line 15 and the discharge line 16 are also drawn, as well as the side part 17, via which the lateral grate-lining unit 12 is connected to a center grate-lining unit 13 via screws 19 (also see FIG. 8) put into the openings 18. It will be seen that the feed and discharge lines 15, 16 have the same inside diameter d as the tubes 9, and thus jumps in cross section having the known adverse effects, e.g. the encouragement of the deposition of foreign particles, are avoided.

FIG. 7 represents a section in the head region, that is, at the front end of the grate-lining unit 12, along line VII—VII in FIG. 6. In this example, openings 8 for the primary-air feed are arranged in the head region of the grate-lining unit and can easily be seen in FIG. 7.

It is essential for the invention that the second lateral, i.e. left-hand here, grate-lining unit 11 arranged on the other side of the row of grate-lining units is designed to be a mirror image of the grate-lining unit 12, i.e. the connections 10 for the feed and discharge lines 15, 16 are located on the other narrow side of the grate-lining unit and, in a representation analogous to FIG. 5, would be arranged not at the top but at the bottom.

Figure 8:
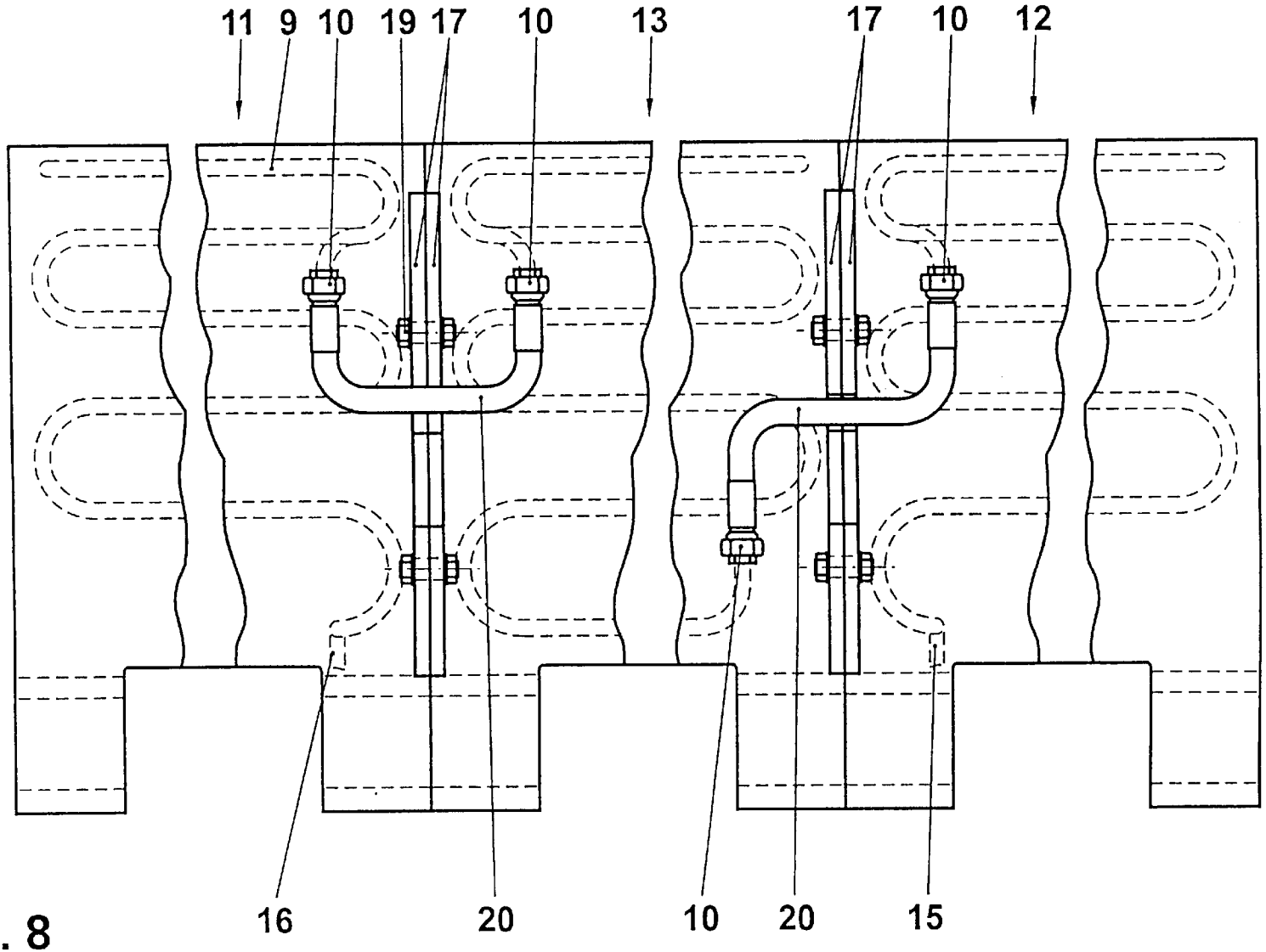
FIG. 8 shows a plan view of a row of grate-lining units having two lateral grate-lining units and one center grate-lining unit.

FIG. 8 shows an overall plan view of a row of grate-lining units having two lateral grate-lining units 11, 12 and a center grate-lining unit 13. The mirror-image configuration of the lateral grate-lining units 11, 12 according to the invention can easily be seen.

The center grate-lining unit 13 is distinguished by the fact that the two connection points 10 are arranged on the narrow sides of the grate-lining unit 13 opposite one another and not on one side as in the lateral parts 11, 12, one connection point 10 each being provided in the front end and in the rear end of the grate-lining unit 11, 12, 13. The tube 9 of the center grate-lining unit 13 is connected to the tubes 9 of the two lateral grate-lining units 11, 12 via an S-shaped and a U-shaped coupling 20, the couplings 20, the tubes 9 and the feed and discharge lines 15, 16 having the same inside diameter d. A uniform cross section of flow for the cooling medium is thereby obtained and the formation of vortices in the flow and the deposition of foreign particles are prevented.

The left-hand lateral grate-lining unit 11 is connected to the center grate-lining unit 13 and the latter is connected to the right-hand lateral grate-lining unit 12 via a screwed connection of the side parts 17 with screws 19. The feed line 15 and the discharge line 16 of the tubes 9 are arranged in the lateral grate-lining units 11, 12 in each case on that narrow side of the grate-lining unit 11, 12 which is directly adjacent to the center grate-lining unit 13. Therefore the feed and discharge lines 15, 16 are not arranged in the grate marginal zone, which is not very accessible, as in the known prior art but are arranged so as to be displaced more toward the grate center so that they are readily accessible.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A grate for a firing plant comprising:

at least one grate track including a plurality of fixed and moving rows of grate-lining units, said fixed and moving rows alternating in a longitudinal direction of the grate along the track, said rows being bound on each side by a side wall, and each said row comprising at least one grate-lining unit provided with feed and discharge lines and with cooling passages, each of the grate-lining units being pivotably connected at a rear portion of each of the grate-lining units to a fixed or movable grate-lining bearer and being movably arranged with a front portion on or above an adjacent grate-lining unit, and said at least one grate-lining unit in each said row being connected by connecting means, said connecting means arranged below said at least one grate-lining unit, such that adjacent grate-lining units are pivotable to a limited extent relative to a respective said grate-lining bearer and the cooling passages are arranged transversely to the longitudinal direction of the grate, wherein the cooling passages are tubes arranged in a meander shape and integrally cast in the grate-lining units, the tubes being variably spaced from each other in the longitudinal direction of the grate so as to be adapted to a predetermined thermal loading on the grate.

2. The grate for a firing plant as claimed in claim 1, wherein tubes in the front portion of each of the grate-lining units more closely to each other in the longitudinal direction of the grate than are tubes in the rear portion of each of the grate-lining units.

3. The grate for a firing plant as claimed in claim 1, the grate track comprising two lateral grate-lining units and at least one central grate-lining unit arranged in between the lateral grate-lining units, wherein the lateral grate-lining units are designed to be mirror images of one another with regard to the cooling passages, each of said two lateral grate-lining units having an inner side adjacent said at least one central grate-lining unit and an outer side adjacent one of said side walls, wherein connection points for feed and discharge lines are arranged in each of said two lateral grate-lining units on said respective inner side of each of the lateral grate-lining units.

4. The grate for a firing plant as claimed in claim 3, wherein the connection points for the feed and discharge lines are arranged in the grate-lining units such that there is a first connection point at the rear portion of each of the grate-lining units and an additional connection point at the front portion of each of the grate-lining units.

5. The grate for a firing plant as claimed in claim 1, wherein the tubes in adjacent grate-lining units in a row of grate-lining units are connected to one another via a coupling.

6. The grate for a firing plant as claimed in claim 5, wherein said coupling comprises a tube or a hose connection.

7. The grate for a firing plant as claimed in claim 5, wherein said coupling has a U-shape.

8. The grate for a firing plant as claimed in claim 5, wherein said coupling has an S-shape.

9. The grate for a firing plant as claimed in claim 5, wherein the couplings, the feed and discharge lines, and the tubes integrally cast in the grate-lining units each define an inside diameter, said inside diameters of the couplings, the feed and discharge lines and the tubes being substantially equal.

10. The grate for a firing plant as claimed in claim 1, further comprising openings for primary-air feed arranged between the tubes.

11. The grate for a firing plant as claimed in claim 1, wherein spacing of the tubes in the meander shape from the front portion to the rear portion of each of the grate-lining units is varied dependent upon the thermal loading on the grate-lining units.

* * * * *